United States Patent [19]

Small

[11] Patent Number: 4,633,248

[45] Date of Patent: Dec. 30, 1986

[54] WELL LOGGING INSTRUMENT INCLUDING SHOCK ISOLATION SYSTEM

[75] Inventor: Tony M. Small, Houston, Tex.

[73] Assignee: Halliburton Company, Duncan, Okla.

[21] Appl. No.: 632,493

[22] Filed: Jul. 19, 1984

[51] Int. Cl.[4] ..... G01V 1/00

[52] U.S. Cl. ..... 340/853; 367/25; 367/911; 361/394; 267/174

[58] Field of Search ..... 367/25, 34, 911; 181/102; 248/632, 635, 626, 638, 637; 267/174, 178, 180, 96; 277/97, 98; 92/192, 198, 200; 340/853, 854, 856; 361/394, 395, 415; 376/302, 285

[56] References Cited

U.S. PATENT DOCUMENTS 2,494,896 1/1950 Mummert ..... 92/198

4,038,138 7/1977 Linning et al. ..... 376/436

4,157,657 6/1979 Hinchman ..... 73/53

*Primary Examiner*—Charles T. Jordan

*Assistant Examiner*—John W. Eldred

*Attorney, Agent, or Firm*—William J. Beard

[57] ABSTRACT

A well logging sonde adapted to be lowered in a wellbore which incorporates an improved shock isolation system is set forth in the preferred and illustrated embodiment. An electronic support wafer or circuit board mount within the sonde is enclosed within the outer steel case or housing. Shock mounting is achieved by imposing a spring member having oval cross section turns between the support wafer and the surrounding housing. The wafer has a shallow circumferential groove cooperatively shaped for receiving the spring member. A preferred material for the spring member is beryllium copper alloy.

13 Claims, 3 Drawing Figures

FIG. 1
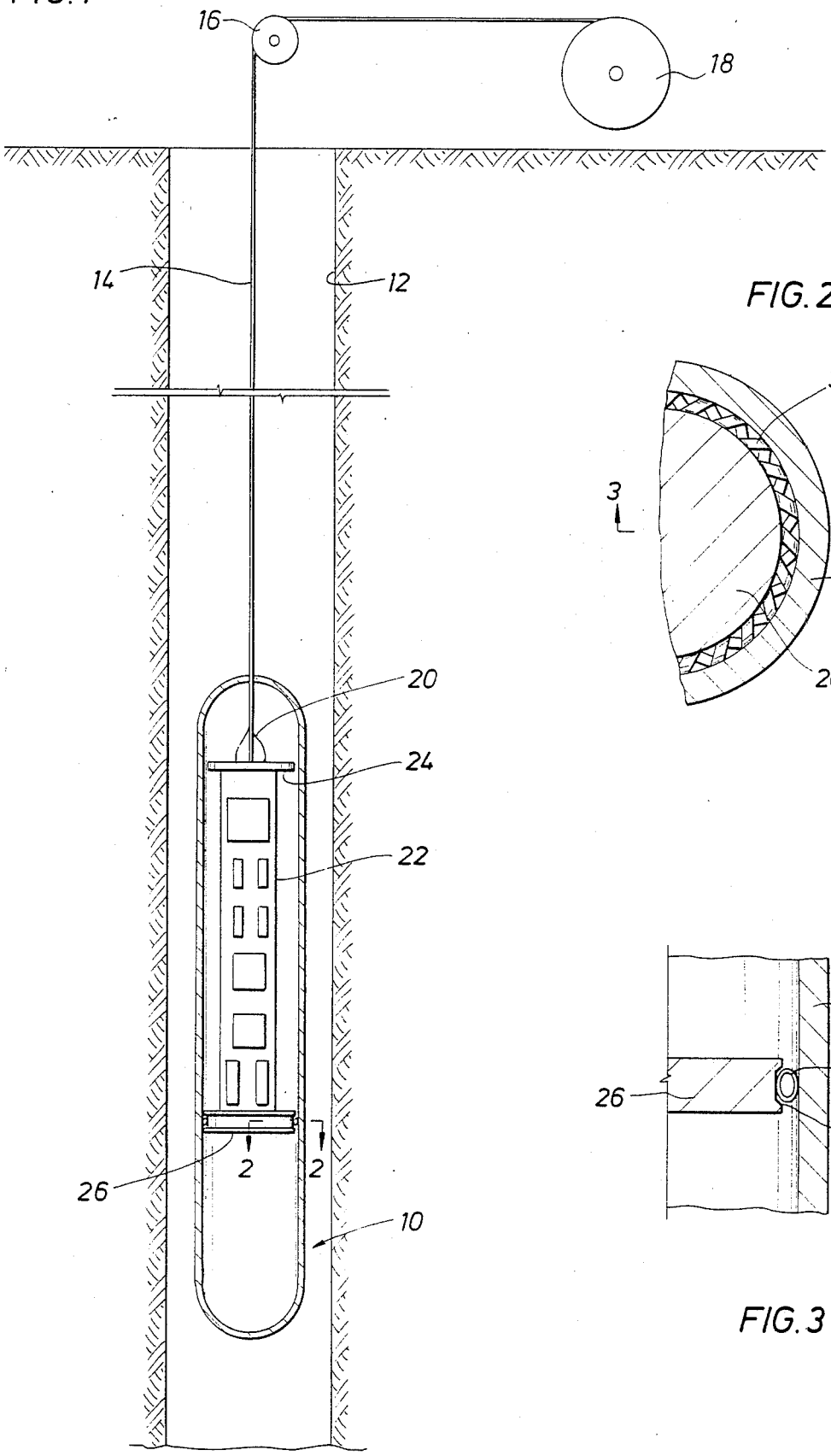
FIG. 2
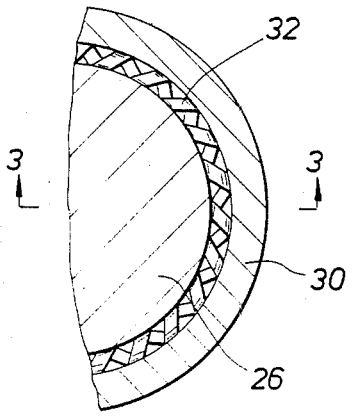
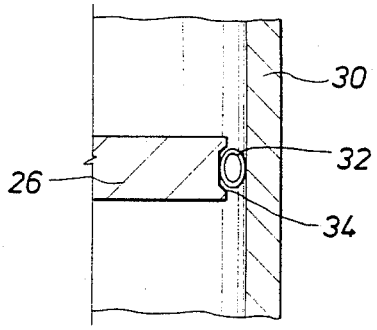
FIG. 3

WELL LOGGING INSTRUMENT INCLUDING SHOCK ISOLATION SYSTEM

BACKGROUND OF THE INVENTION

A sonde or fluid tight hollow body member for enclosing downhole well logging instrumentation is exposed to substantial shock. For instance, it is exposed to significant shock impact during transportation. When loaded on a logging truck bumps in the road (roads to oil well sites are notoriously poor) could create very high shock impact as the tool bounces unconstrained in its metal container. Moreover, a sonde lowered to the bottom of a well is typically retreived at relatively high speed as it pulled up through the well bore hole. It might be pulled at a rate of 120 feet per minute suspended on a logging cable as it is hoisted from the well. When it moves at this velocity and swings from side to side even slightly, it bangs against the surrounding casing or open hole and again experiences significant shock loading.

Another envirnmental hazard is encountered by downhole logging equipment lowered into a well borehole. This involves heat transfer primarily from the circuitry supported in the sonde which generates heat to the borehole. The amount of heat depends on the nature of the circuitry. In some instances, the amount of heat can be quite large, and the heat transfer rate required from the electronic components is substantial. Heat transfer can be improved by utilizing metallic supports to fasten the electronic components in the housing or sonde, but this inevitably couples vibration from the housing back to the electronics components. To the degree that the electronics are isolated from vibration, such isolation typically also provides thermal isolation and hence tends to concentrate heat at hot spots within the housing.

The present invention provides an apparatus which enables construction of a shock mounting in a logging sonde. The shock mounting isolates the electronic package so that the vibration experienced at the housing is not directly or fully coupled to the electronic components. On the other hand, the shock mount apparatus of the present invention provides an improved heat transfer rate. For this reason, the apparatus of the present invention enables simultaneous high quality shock or vibration isolation with good heat transfer for electronic packages in a downhole sonde.

Another important feature of this apparatus is the provision of a vibration isolation system which can be adapted to various sizes and shapes of components. That is, it can accommodate electronic component supports including circular wafers or lengthwise circuit boards. In all instances, the apparatus accommodates variations in shape and profile. Separately, the device is able to withstand vibrations substantially indefinitely because the possibility of metal fatique is nil.

The apparatus of the present invention may be summarized as an oval turn coil spring member placed in cooperative engagement with a shallow groove wherein the coil spring member is interposed between the outer sonde housing and an electronic support wafer. The device will be understood more readily upon a review and consideration of the description of the preferred embodiment below in conjunction with the drawings incorporated herewith.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 1 is a schematic sectional view of a well logging equipment housing or sonde having electronic components supported on an electronic support wafer and wherein the vibration and shock isolation system of the present invention is incorporated to protect the electronic components;

FIG. 2 is an enlarged sectional view taken along the line 2—2 of FIG. 1 showing a coil spring having oval turns positioned between an electronic support wafer and the surrounding housing; and FIG. 3 is a sectional view along the line 3—3 of FIG. 2 showing details of construction of the spring and a circumferential groove securing the apparatus in position.

DETAILED DESCRIPTION OF THE PREFERRED EMBODIMENT

Attention is directed first to FIG. 1 of the drawings which illustrates a well logging tool housing or sonde 10 lowered into a well 12 to conduct downhole logging operations. The sonde 10 is supported on an armored logging cable 14 which is passed over a sheave 16. The logging cable 14 is supplied from a spool or reel 18. This cable enables the sonde to be lowered into the well and to be retrieved from the well. The sonde or tool housing encloses and protects electronic components. The electronic components are connected by suitable conductors 20 to the logging cable 14. Typically, the electronic components are placed on a printed circuit board (PCB) or the like which is typified at 22. The PCB is typically a rectangular board which has a width to enable it to fit within the sonde and which has a length determined by the number of components. In some instances, two or more PCBs are placed parallel to one another in the tool, again depending on the number of electronic components to be enclosed and the space available for them.

An important factor to note is that the PCB is supported between an upper electronic support wafer 24 and a similar lower wafer 26. These wafers 24 and 26 are circular transverse bulkheads located in the sonde 10. It is desirable that wafers 24 and 26 span the full inside diameter of the device. If desired, they can be perforated at suitable locations to enable electrical to extend through them. Typically, wafers 24 and 26 are located at the ends of the PCB to support the PCB. The PCB is typically rather thin and light. It must be anchored at both ends to provide substantial rigidity to the PCB to thereby enable the device to be used in the rugged environmental conditions which are normally encountered. In the ordinary arrangement, there are several support wafers such as wafers 24 and 26 spanning the structure and there may by several PCBs located in the structure. The PCBs are different in function, size and weight. However, they have a similar requirement in that they all are best operated with a degree of isolation from shock and vibration, and they are all susceptible to generating heat which is best conducted to the exterior.

Attention is now directed to FIG. 2 of the drawings which is a sectional view along the line 2—2. There, it will be first noted that a surrounding cylindrical housing 30 encloses the structure. The housing 30 is typically a ruggedized structural outer body of steel. In some instances, the housing 30 can be made of composite materials such as fiberglass or the like. In some instances the housing 30 may be made of steel, other metals such as titanium or alloys. Ordinarily, it is constructed to withstand severe shock and pressures up to 20,000 psi, and typically has substantial life because it is sufficiently thick and rugged to survive in a borehole environment as a result of the rugged construction. The housing 30 is provided with an internal diameter or face which supports the components which are slipped into it. Typically, the housing 30 is opened at one end (or both ends) and the components for the interior slipped in. To achieve this, they must slide smoothly into the housing. Such a construction permits the use of transverse bulkheads which fit rather snuggly with only modest clearance. Actually, any clearance which permits the transverse support wafer to oscillate or impact against the housing is undesirable. That has been prevented in the past by providing such little clearance that the transverse bulkhead is, for all intents and purposes, only about 0.010 to about 0.050 inches less in diameter than the interior of the housing. Often, a rubber shock suppressor or other material is used to wedge the wafer. This snug fit is desirable for structural rigidity, but such structural rigidity may well transfer vibration and shock to the electronic components.

The apparatus of the present invention overcomes that difficulty. As shown in FIG. 2, the numeral 26 again identifes the support wafer which is circular disk. There is substantial clearance between the edge of the disk 26 and the surrounding housing 30. This gap or clearance enables a coil spring member 32 to be positioned between the two components. The spring 32 is of the coil spring type having oval or round shaped cross section on the individual turns of the coil. The oval shape creates a preferential axis for the spring. The support wafer 26 is formed with a circumferential groove at 34 as better shown in FIG. 3. There are therefore two spaced protruding lips that capture the coil spring 32. The spring 32 thus has a preferential oval or egg shape profile which causes the spring to position itself between the spaced lips that define the groove 34. The spring stands above the lips and therefore has an outside edge which contacts the inside diameter of the housing 30.

The spring is formed into a full circle to enable the spring to fully encircle the support wafer 26. The full length of the spring encircles the entire wafer centered in the housing. Thus, the spring is sized so that it will fit where it bottoms in the groove and yet has an outer face or edge contacted against the surrounding housing 30. The height to width ratio for the coil spring member 32 can be varied between about 0.40 to about 0.90. It is undesirable that the spring be round. Such a round cross section coil spring would not have a preferential position relative to the groove which supports the spring. The oval cross section arrangement, however, continues to present only one edge of the spring to the housing and takes advantage of the oval shape to restore the spring to the initial neutral position.

As viewed in FIG. 3, should the coil spring member 32 move to either side, such movement would be accompanied by increased hoop tension in the spring as it elongates. Such movement would follow as the spring climbs the adjacent lips defining the groove. Also, the hoop tension increases as a result of rolling the oval turns to reposition the oval dimension at right angles. The oval shape thus creates a restoring force that tends to keep the coil spring member 32 centered in the groove 34 and also which prevents rolling of the spring member 32 in the groove 34 as might occur with a round cross section spring.

The preferred material for the spring member 32 is a beryllium copper alloy. Such a material has extremely long life and is substantially free of metal fatigue problems. Keeping in view that the vibration rate might easily accummulate millions of cycles in just a few weeks of use, the spring material is extremely durable and resilient and therefore is highly desirable to provide shock and vibration isolation. Shocks in the range of 50 g and more to the housing 30 are damped and substantially reduced at the PCB boards containing the electronics. Such damping is accomplished in the oval turn spring. Moreover, the beryllium copper alloy is substantially wear and fatique resistant over a long period of time.

An important feature in the present apparatus is the incorporation of beryllium copper for the spring member 32 as a heat transfer material. The beryllium copper alloy has far greater heat transfer characteristics than stainless steel as an example. It has even more heat transfer capacity then aluminum. In addition to the shock isolation provided by the spring member 32, the use of a beryllium copper coil spring especially provides good heat transfer from the electronic support wafer into the housing for cooling purposes. To this end, the electronic support wafer is preferably constructed of a material which is a good heat conductor. It is preferable to arrange heat sinks on the PCB thermally communicated with the wafer 26 so that the heat is transferred from the PCB to the wafer 26 and thence from the spring member 32 to the outer housing 34.

The beryllium copper coil thus serves both purposes, namely vibration isolation and desirable heat transfer. This feature can be very valuable in protecting the electronic equipment carried on the PCB.

For a tool which has a nominal diameter of about 3.62 inches, a typical ID might be about 2.88 inches while the wafer 26 might have an OD of 2.72 inches. The groove 34 might have a depth of about 0.06 to about 0.28 inches. In this instance, the spring minor axis of the oval cross section would be approximately 0.10 to about 0.16 inches tall. That is, the confined space formed by the wafer 26 groove would permit such coil turn height. The spring member 32 is slightly compressed from its relaxed state and hence, it provides a slight interference fit at the time that it is inserted into the housing along with the electronic support wafer 26. At the time of assembly, the spring member 32 is fitted into the groove 34 around the electronic support wafer 26. Thereafter, the electronic package including the support wafer 26 is slipped into the housing 30. It is necessary to slightly compress the spring 34 during insertion. This compression causes the flattening of the oval. Ordinarily, the spring is fitted around the circumference of the support wafer 26 in slight tension to assure that it stays confined in the groove 34.

Removal of the electronic components is typically accomplished by simply slipping the components out of the housing 30. Assuming that the housing has no burrs or other internal snags, the spring 30 simply slides over the inside face of the housing 30 and the apparatus can be removed.

While foregoing description is directed to a preferred embodiment, the scope of the invention is determined by the claims which follow.

What is claimed is:

1. A downhole logging tool having an external pressure housing which may be subjected to shock or vibration, and which encloses and supports electronic components carried interiorly on a support wafer, and including a system for mounting electronic components in the housing which system comprises an electronic support wafer having an edge thereon of finite width and a circumferential retaining groove therein and wherein the edge is adapted to be spaced from and at approximately right angles to the inside surface of the pressure housing, and a spring member positioned therebetween with the axis of said spring member extending parallel to the edge of said support wafer, said spring member being received against the edge of said wafer wherein said spring member is made of repetitive turns and the turns thereof, in cross-section transverse to the axis of the spring member are oval turns, and wherein said spring member has a bias tending to position one side of said spring member toward said housing and the opposite side toward said support wafer.

2. The apparatus of claim 1 wherein the oval spring member has a height to width to ratio between about 0.4 and 0.9.

3. The apparatus of claim 2 wherein said oval turns have a finite width limited by a peripheral groove of shallow construction.

4. The apparatus of claim 1 wherein said spring member is formed of beryllium copper alloy.

5. The apparatus of claim 1 wherein said spring member is positioned around said support wafer and said support wafer is circular and has a surrounding peripheral groove on the edge thereof and said spring member is received in said groove.

6. The apparatus of claim 5 wherein said groove is defined by two parallel lips adjacent to a shallow recess, and said spring member sits therein.

7. The apparatus of claim 6 wherein said spring member is made of oval turns biased by the contrast in dimensions thereof tending to roll said spring member to a preferred position presenting only one face to the facing housing.

8. The apparatus of claim 7 wherein said oval turns, on capture between said wafer and said housing, are compressed.

9. The apparatus of claim 8 including a smooth, slidable, opposing face in said housing enabling said oval turns to slide thereagainst.

10. A downhole logging tool having an external pressure housing which may be subjected to shock or vibration, and which encloses and supports electronic components carried interiorly on a support wafer, and including a system for mounting electronic components in the housing which system comprises an electronic support wafer having an edge thereon of finite width and a circumferential retaining groove therein and wherein the edge is adapted to be spaced from and at approximately right angles to the inside surface of the pressure housing, and a spring member positioned therebetween with the axis of said spring member extending parallel to the edge of said support wafer, said spring member being received against the edge of said wafer and wherein said spring member has a bias tending to position one side of said spring member toward said housing and the opposite side toward said support wafer:

(a) wherein said spring is positioned around said support wafer and said support wafer is circular and has a surrounding peripheral groove on the edge thereof and said spring is received in said groove;

(b) wherein said groove is defined by two parallel lips adjacent to a shallow recess, and said spring sits therein; and (c) wherein said spring member is made of repetitive turns and the turns thereof, in cross-section transverse to the axis of the spring, are oval turns.

11. The apparatus of claim 10 wherein said oval turns are biased by the contrast in dimensions thereof tending to roll said spring to a preferred position presenting only one face to the facing housing.

12. The apparatus of claim 11 wherein said oval turns, on capture between said wafer and said housing, are compressed.

13. The apparatus of claim 12 including a smooth, slidable, opposing face in said housing enabling said oval turns to slide thereagainst.

* * * * *